United States Patent [19]

Hornsby, Jr.

[11] 3,957,202

[45] May 18, 1976

[54] NOVELTY DRINKING STRAW

[76] Inventor: James R. Hornsby, Jr., 6239 Edgewater Drive, Orlando, Fla. 32810

[22] Filed: Sept. 17, 1975

[21] Appl. No.: 614,310

[52] U.S. Cl. ..... 239/33; 46/1 R; 426/85

[51] Int. Cl.[2] ..... A47G 21/18

[58] Field of Search ..... 239/33, 16, 17, 24; 46/1 R; 426/78, 81, 85, 82, 89, 104, 135

[56] References Cited

UNITED STATES PATENTS

| | | | |
|---|---|---|---|
| 2,063,803 | 12/1936 | Gildersleeve | 239/33 |
| 2,248,231 | 7/1941 | Hamilton | 239/33 |
| 2,867,536 | 1/1959 | Mead et al. | 426/85 |
| 2,983,616 | 5/1961 | Levi | 426/85 |
| 3,615,595 | 10/1971 | Guttag | 426/85 |

*Primary Examiner*—Robert S. Ward, Jr.
*Attorney, Agent, or Firm*—Roylance, Abrams, Berdo & Kaul

[57] ABSTRACT

A novelty drinking straw has a layer of liquid crystalline material disposed thereon. As liquid is drawn through the straw, the color of said liquid crystalline material changes.

7 Claims, 4 Drawing Figures

NOVELTY DRINKING STRAW

This invention relates to drinking straws of the type commonly used to orally withdraw liquid from a container, and more particularly, it relates to a drinking straw of the novelty type which exhibits unique color changeable characteristics when in use.

Drinking straws are a well-known and widely used expedient for oral ingestion of various liquid substances. Such drinking straws are customarily formed as elongated tubular members, fabricated of plastic or paper, and having a central bore extending fully therethrough. In use, the lower end of the straw is inserted into a receptacle containing liquid and the upper end of the straw is positioned between the user's lips. When the user then exerts a suction action through the straw, liquid is drawn from the container and into the user's mouth.

There have in the past been certain attempts to modify drinking straws in an endeavor to create a novelty form of straw which, while serving the basic function of a conventional straw, nevertheless has some unique or novel feature which makes it attractive for use by children and adults alike. For example, a known form of novelty drinking straw consists of a spirally curved straw member wherein the liquid which is drawn through the straw must traverse through a spirally extending path before reaching the user's mouth.

It is a primary object of the present invention to provide a new and unique form of novelty drinking straw, which, while serving the basic function of a conventional drinking straw, nevertheless has certain unique, novel and attractive features which reveal themselves while the straw is used.

Another object of the present invention is to provide a color changeable drinking straw wherein the color of the straw is visibly changed as liquid is drawn therethrough, such color change being completely independent of the color of the liquid which is being consumed through the straw.

Further objects of the present invention include the provision of a novelty drinking straw which can be manufactured relatively inexpensively, which is safe to use, and which can be used repeatedly for an extended period of time without failure.

Other objects, advantages and salient features of the present invention will become apparent from the following detailed description, which, taken in conjunction with the annexed drawing, discloses a preferred embodiment thereof.

The foregoing objects are attained by providing a conventional drinking straw with a layer of liquid crystalline material of the type which exhibits color changeable characteristics in response to temperature variations. Examples of suitable forms of such liquid crystalline material will be set forth in detail hereinafter. The liquid crystalline material is preferably disposed exteriorly of the straw and is covered by a transparent membrane which prevents the liquid crystalline material from coming into contact with the liquid in which the straw is immersed or into contact with the user's lips or mouth. As the liquid from the container is drawn through the straw, the liquid crystalline material will change color due to the fact that in most instances the temperature of the liquid being drawn through the straw will be different from the ambient temperature surrounding the straw.

Referring now to the drawings, which form a part of this original disclosure:

Figure 1:
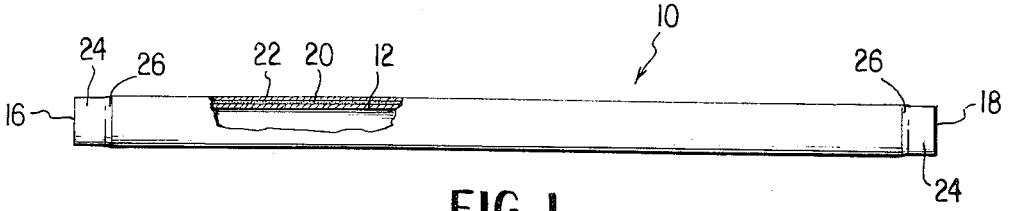
FIG. 1 is a side elevational view, partially in section, of a novelty drinking straw in accordance with the principles of the present invention.

Referring now to the drawings in further detail, the novelty drinking straw of FIG. 1 is generally designated 10. The drinking straw includes an elongated tubular body member 12 having the central bore 14 extending fully therethrough from one end 16 to the other end 18. The member 12 is preferably formed of a plastic material, rather than of paper, so that the straw can be reused several times.

A layer of liquid crystalline material 20 is disposed upon the exterior surface of the tubular member 12 and extends along at least a portion thereof. The nature of the liquid crystalline material is such that it undergoes spectral color changes of an iridescent nature in response to temperature changes. Such materials are often referred to as Mesomorphic compounds and they are customarily formed of cholestryl esters, a type of compound having the unique property of scattering light of various colors over a specific short temperature range wherein the colors vary in accordance with the temperature within that range. Moreover, the color change is reversible so that if the colors change from red through the spectrum to blue upon heating of the liquid crystal material, the reverse colors will appear as cooling occurs.

The specific compound from which the liquid crystal material 20 is formed can be of the type disclosed in U.S. Pat. No. 3,441,513, issued to W. E. Woodmansee on Apr. 29, 1969 or U.S. Pat. No. 3,620,889, issued to D. H. Baltzer on Nov. 16, 1971, the disclosures of which are hereby incorporated by reference. Moreover, the liquid crystal material 20 can be of the type which is encapsulated as is disclosed in U.S. Pat. No. 3,585,381, issued to T. L. Hodson et al on June 15, 1971, or U.S. Pat. No. 3,732,119, issued to D. Churchill et al on May 8, 1973, or U.S. Pat. No. 3,795,529, issued to J. V. Cartmell et al on Mar. 5, 1974, the disclosures of all such patents being incorporated herein by reference.

Figure 3:
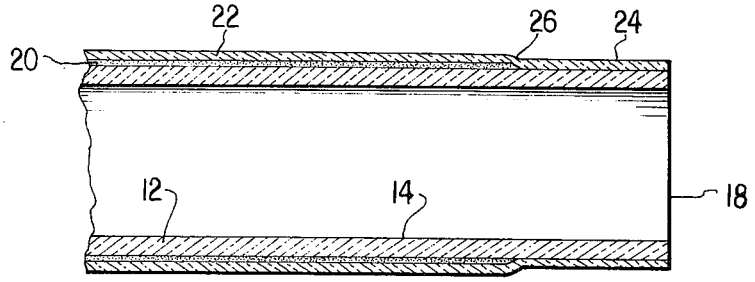
FIG. 3 is an enlarged fragmentary sectional view of the end portion of the straw of FIG. 1 or FIG. 2.

In order to prevent the liquid crystalline layer 20 from being contacted by the user's fingers when the straw is in use, or alternatively, from coming into direct contact with the liquid which is to be drawn through the straw, a transparent membrane covering material 22 is provided in overlying relationship to the layer 20. The membrane 22 can be advantageously formed of a Mylar film and the membrane layer 22 completely surrounds the exterior portion of the straw body member 12 and is adhered at two spaced locations along the member 12, namely, the opposed ends thereof. As shown in FIG. 3, at the portion designated 24 adjacent the end 18 of the straw, the membrane 22 is adhered directly to the exterior surface of the tubular body 12. The term "adhered" as used herein is intended to include both attachment by means of adhesive as well as direct heat fusion or coherence of the membrane 22 to the body 12 of the tubular member.

Figure 2:
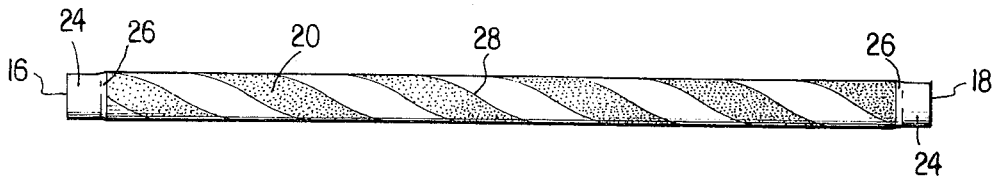
FIG. 2 is a side elevational view of a modified drinking straw in accordance with the principles of the present invention.
Figure 4:
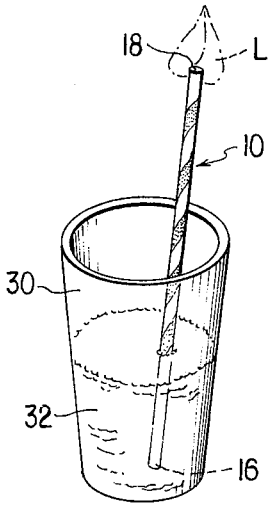
FIG. 4 is a diagrammatic view showing the manner in which the novelty drinking straw of the present invention is used.

The layer of liquid crystalline material 20 can be either continuous or discontinuous between the spaced end locations 24 where the membrane 22 is adhered to the tubular body 12. As best shown in FIG. 3, the liquid crystalline material 20 terminates at the juncture 26 where the membrane attaches to the straw body. The term "continuous" as used herein means that the liquid crystal layer 20 completely surrounds and encircles the tubular body 12 between the spaced juncture portions 26. The term "discontinuous" as used herein means that the liquid crystalline material does not completely surround and encircle the straw between these juncture portions, but instead, can be arranged in stripes, bands or any other suitable design. As illustrated in FIGS. 2 and 4, the layer of liquid crystalline material 20 can extend helically about the exterior surface of the tubular member 12, such helical arrangement being designated 28 in FIG. 2.

In FIG. 4, there is illustrated a container 30 in the form of a glass having a liquid 32 therein which is intended to be drawn through the straw 10. In FIG. 4, one end 16 of the straw is immersed within the liquid 32 while the other end 18 of the straw extends above the container 30 to be grasped between the user's lips which are diagrammatically shown and illustrated as L. Before the straw is inserted into the liquid 32, it has a certain ambient termperature, namely, room temperature when the straw is retained immediately prior to usage. As the straw is inserted in the liquid 32, which liquid will ordinarily be less than the ambient temperature, the color of the liquid crystalline material beneath the surface level of the liquid 32 will be changed. Then, as the user orally draws the liquid 32 through the straw, thus causing the liquid to pass upward through the bore 14 of the straw, the temperature of the rising liquid will be transmitted through the walls of the member 12 to the layer of liquid crystalline material 20, thus causing such liquid crystalline material to change color. After the user stops drawing the liquid 32 through the straw, the color of the exposed liquid crystalline layer will reversibly change after a few seconds back to its original color. However, each time the liquid is drawn through the straw, the liquid crystalline material will again change color hence giving the straw an illuminated iridescent appearance which is unique and attractive. The liquid crystalline layer color changes will differ depending upon whether the liquid 32 is above or below the ambient temperature.

After reading the foregoing detailed description, it should be apparent that the subject invention achieves the objects set forth at the outset hereof. Various changes and modifications apparent to those skilled in the art may be made without departing from the spirit and scope of the invention as defined in the appended claims.

What is claimed is

1. A novelty drinking straw comprising:

an elongated tubular member having a central bore extending therethrough, said tubular member having an exterior surface;

a layer of liquid crystalline material disposed upon at least a portion of said exterior surface; and a transparent membrane covering said liquid crystalline layer to prevent said layer from contacting a liquid in which said member is immersed for the purpose of orally drawing said liquid through said bore.

2. A novelty drinking straw as defined in claim 1 wherein said liquid crystalline material is color changeable when the temperature of the liquid drawn through the straw varies from the ambient temperature.

3. A novelty drinking straw as defined in claim 2 wherein said membrane is adhered to said exterior surface at two spaced locations along said member and wherein said liquid crystalline layer extends between said spaced locations.

4. A novelty drinking straw as defined in claim 3 wherein said liquid crystalline layer extends continuously along said exterior surface between said spaced locations.

5. A novelty drinking straw as defined in claim 3 wherein said liquid crystalline layer is discontinuous along said exterior surface between said spaced locations.

6. A novelty drinking straw as defined in claim 5 wherein said liquid crystalline layer extends helically about said exterior surface.

7. A novelty drinking straw comprising an elongated tubular member having a central bore extending fully therethrough and a layer of liquid crystalline material disposed upon said member.

* * * * *